United States Patent [19]

Jones

[11] Patent Number: 4,583,532

[45] Date of Patent: Apr. 22, 1986

[54] BACK TRACTION DEVICE

[76] Inventor: J. Paul Jones, R.D. 1 Box 171-L, Glenmoore, Pa. 19343

[21] Appl. No.: 660,880

[22] Filed: Oct. 15, 1984

[51] Int. Cl.[4] ..... A61H 1/02

[52] U.S. Cl. ..... 128/75; 128/71

[58] Field of Search ..... 128/69–75

[56] References Cited

U.S. PATENT DOCUMENTS

| | | | |
|---|---|---|---|
| 923,862 | 6/1909 | Langworthy | 128/75 |
| 3,596,655 | 8/1971 | Corcoran | 128/75 |
| 3,605,736 | 9/1971 | D'Amico | 128/75 |
| 3,621,839 | 11/1971 | Barthe | 128/75 |
| 3,643,996 | 2/1972 | Carnahan | 128/75 |
| 4,166,459 | 9/1979 | Nightingale | 128/75 |

*Primary Examiner*—Edgar S. Burr
*Assistant Examiner*—William L. Klima

[57] ABSTRACT

The invention is designed to provide controlled cyclic traction to a person who is seated on a chair next to a vertical member such a door or wall. In use, the machine is mounted in a vertical position and the person being treated sits in a chair with his head near the machine. The machine consists of an electronically controlled motor drive housing which is mounted above two precision rails, on which a moving carriage contains the combination of a pivotally mounted chin band and a contoured neck rest, which, by their configuration, can grip the persons head firmly, while not requiring any straps or fasteners which can not be quickly disconnected. The carriage has a dial adjustment for setting the maximum pressure or traction that may be exerted on the patient; and this pressure limit is not affected by any change of position by the patient.

A hand held remote control box enables the person being treated to completely control the initial position of the carriage and the cyclic modes of operation, at the push of a button. Internal sensors detect and maintain the limits of travel to the amount of tension that has been set into the machine. A "panic" button on the hand held control box also immediately stops the action of the machine, at the command of the patient, who does not have to disrobe or lie down for the treatment.

1 Claim, 5 Drawing Figures

BACK TRACTION DEVICE

The application of cyclic traction to the human back as a means of relieving pressure and the associated pain is not a new concept. Traction can be applied for many reasons, including: (1) the strengthening of the connecting ligaments to the spinal vertebrae, which can be hurt by accidents or weakened by degeneration or poor health; (2) the allignment of the vertebrae to improve posture and remove pressure points; and (3) the relief of intense pain and pressure, which may be caused by misallignment of the individual vertebrae or "slipped disc".

Various devices have been used by chiropractors and Osteopathic physicians which generally require the patient to be in a reclining position on a machine which requires the patient to be "strapped in" with a fairly elaborate head harness to create the traction on the spinal column. The units that are made for physicians generally require a small room to locate the machines; and because of FDA rules an attendent is needed to strap the patient in and to monitor the traction treatment.

More recently, the principal of traction, or what is called "decompressive exercise", has been popularized by various "hang by the feet" exercise apparatus. The typical apparatus is made like a see-saw and the person using it will start by strapping his feet on to one end while he is standing in an upright position and then tilting the whole apparatus through approximately 180° which in turn raises his feet directly over his head and causes him to hang by his feet. His own body weight, therefore, produces the traction or separation force that "decompresses" his spinal column.

All of these apparatus have the common problem of really requiring help to get mounted into the apparatus and that the apparatus is large in size and occupies a great deal of space in either home or office. This one fact is at odds with the fact that the great percentage of adult males with back problems are usually the sedintary and/or executive type, who are usually overweight, and do not maintain good physical condition. For the busy executive and his environment neither of these generally used apparatus would be satisfactory, because of their appearance and size or the fact that they cannot be used when the person is fully dressed in semi-formal attire.

Another specific problem associated with the affluent executive type with back problems is that he travels very much and is typically suffering many back problems from driving long distances. Normally he would have no way of getting relief from spasms that may occur from driving, carrying luggage, etc., when he is away from home.

It is, therefore, one object of this invention to provide a fully portable unit for applying controlled cyclic traction to the back at virtually any location.

It is another object of this invention to provide an automatic cyclic traction unit that can be mounted vertically on the wall or on a door just behind an ordinary chair for applying traction to a person's back, while he is seated in the chair.

It is still another object of this invention to provide a vertically mounted traction unit that is totally controllable by the user with a remote control box, so that an attendant is not required.

It is yet another object of this invention to provide a vertically mounted automatic cyclic traction unit which has presetable limits for the amount of pressure that the unit will apply and which will maintain these limits regardless of the change of position of the patient's body.

The two unique features of the new invention which makes all of the objectives and improvements possible are: (1) the rigid, adjustable chin strap which works in conjunction with a form fitting neck pad to provide a comfortable head "grip" that can be easily attached or removed; and (2) the built-in "floating scale" which maintains the absolute preset pressure limits, regardless of the vertical movement of the patient during the operation.

Another important feature of the control system is the hand held remote control box, which with very simple *up* and *down* push buttoms and a mode switch for manual or automatic operation, enables the patient to control his own operation, thereby eliminating the need for a special attendant, and the associated additional cost to the patient.

All of these special operational features of the invention will become more obvious with the following description and appended claims.

BRIEF DESCRIPTION OF THE DRAWINGS

FIG. 1 shows the portable traction unit mounted on a door with a person (5) seated on a chair (6), in front of the machine. The traction machine is made up of a reversible drive unit (1) having an electric motor (16) which elevates or lowers a carriage unit (2) which is slidable mounted on vertical rods (3). The carriage (2) has a pivotally mounted chin strap (8) which engages the chin of the patient (9) and also engages the back of the patient's head with a shaped head rest (7). FIG. 4 is a perspective view of the machine.

Figure 1:
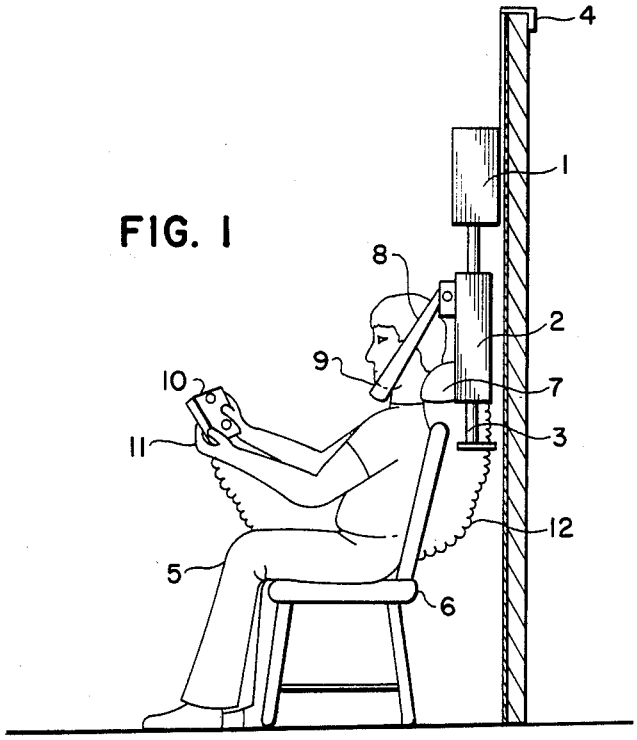
FIG. 1 shows the portable traction unit mounted on a door and connected to a person seated on a chair.

The person (5) is seated on a chair (6) and has adjusted the initial height of the carriage with a remote control box (10) which he is holding in his hand (11) and which is connected to the controls in the machine with a spiral control cable (12).

Figure 2A:
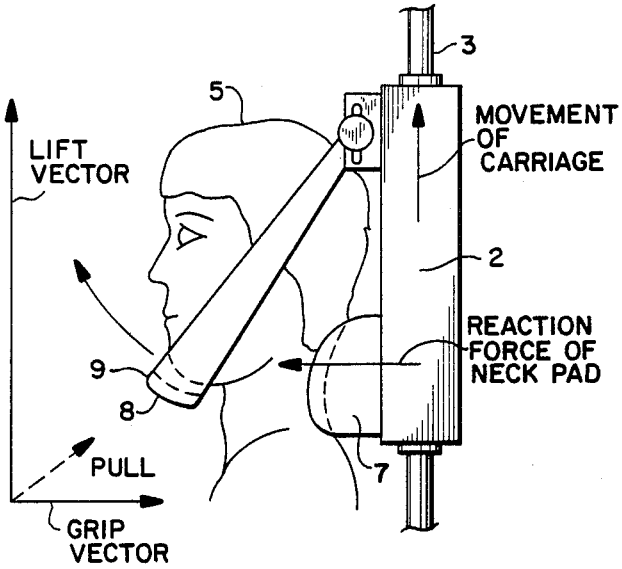
FIG. 2A is a side view of the carriage and chin strap engaged with a person.

FIG. 2A shows a more explicit view of the carriage (2) with the person (5) engaged by the chin strap (8) and the chin pad (9). When the carriage (2) is raised upward and the pull of the chin strap produces a vector force inward against the contoured neck pad (7) which together with the chin strap (8) firmly grasps the head of the person (5) when moving upward.

Figure 2B:
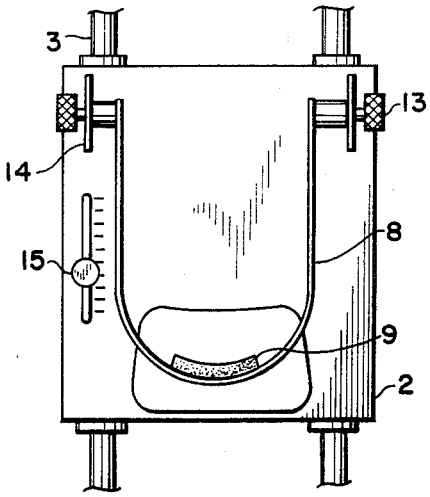
FIG. 2B is a front view of the carriage.

With reference to FIG. 2B, the upward motion and tension on the person (5) is limited by a limit switch setting (15) which has an adjustment knob and a calibrated scale. The initial setting of the chin band (8) is adjusted with knob (13) which tightens the pivot points in a vertical adjustment slot on the brackets (14). Both the chin band (8) and the neck pad (7) work together to clamp the head firmly but comfortably as the carriage moves upward.

Figure 3:
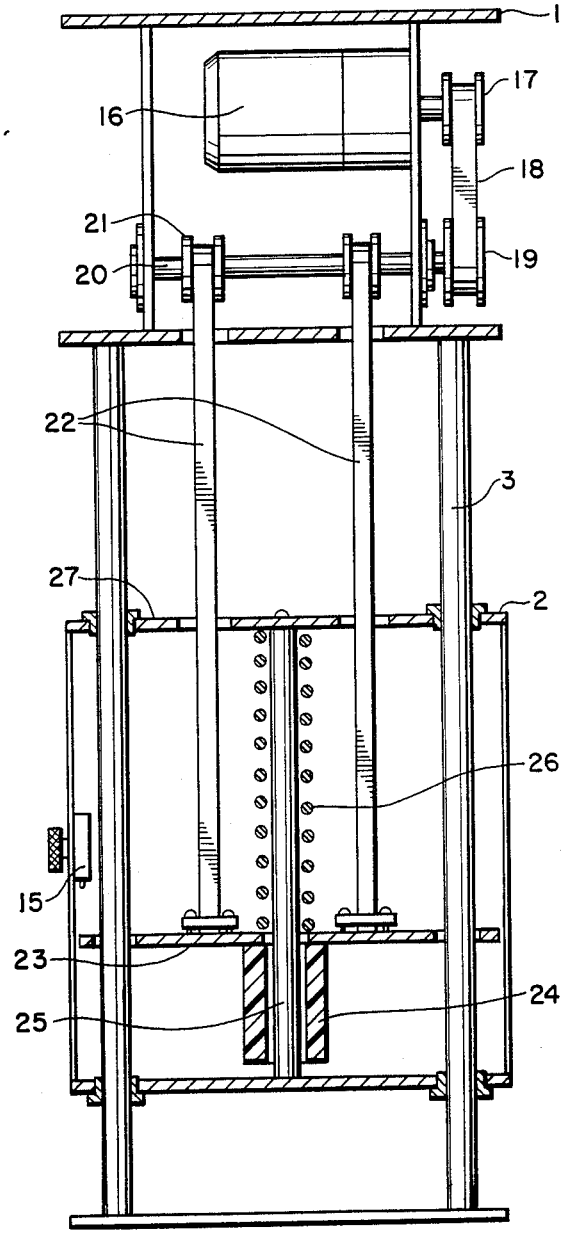
FIG. 3 is a general cross-sectional view of the machine.
Figure 4:
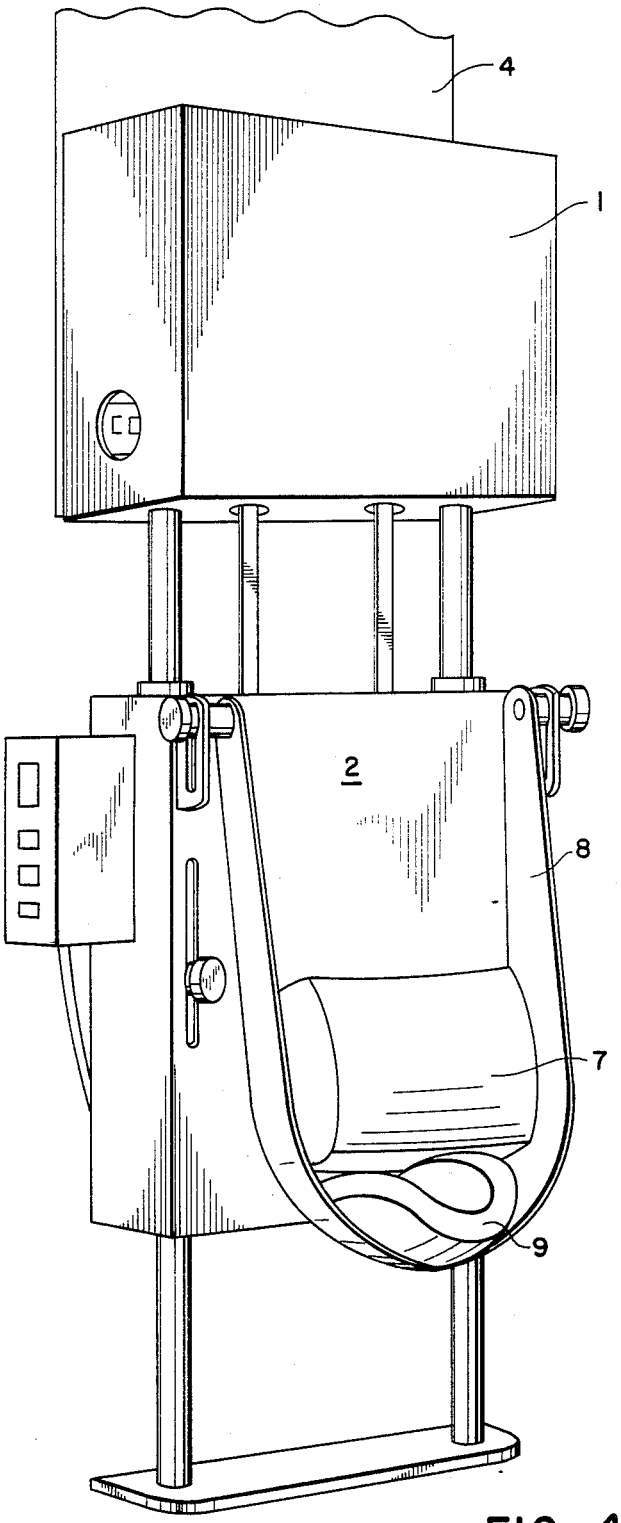
FIG. 4 is a general overall view of the traction device of the invention.

FIG. 3 shows a general cross section of the machine which is made up of a series of plates which, in turn form the driver unit (1), the carriage unit (2), and the lift plate (23) which works against the spring scale (26) to gage the pressure that is exerted to lift the carriage (2).

The drive train begins with the motor (16) which has a pulley (17) connected by a nylon tape belt (18) to a shaft pulley (19). There are two lift pulleys (21) on the drive shaft (20) which reel up the lift tapes (22) which are connected to the lift plate (23). The lift plate (23) is slidably mounted on a center post (25) with a large plastic sleeve bearing (24). When lift is applied by the tapes (22), the lift plate (23) works against the scale spring (26) and presses against the top plate of the carriage (27) to lift the carriage (2). When the motor (16) is reversed by the control circuitry, the carriage (2) is lowered by its own weight on the unreeling tapes (22) and (18). The stop-start and reversing circuits and the limit switchs thereof for the motor (16) are conventional.

The special features of the invention as shown in the figures include: (a) the head of the participant need not be strapped to the machine; and (b) the participant has complete control of the operation with the hand held remote control unit and the unit is always limited in its maximum traction by a limit switch setting. Since the limit switch setting is only relative to the movement of the lift plate (23) which is connected to the carriage top plate through the tension of the scale spring (26) the vertical position of the person is not important. The limit position will only be reached by the proper tension.

As will be apparent to those skilled in the art, the machine is adaptable for automatic cycling; i.e. alternating traction and relaxing by the application of conventional circuitry.

The unique features of the invention, as described in conjunction with its compact size, enables the unit to be carried from place to place and on trips. This can be a real breakthrough for those with cronic back conditions which may need attention at regular intervals.

I claim:

1. A portable back traction machine for use by humans, the machine comprising:

a carriage;

a drive unit having means for mounting the unit on a vertical member and means connected with said carriage to move the carriage up and down in a vertical direction;

a back-of-the-neck pad mounted adjacent the lower end of the carriage, the pad being contoured to fit with the back of the neck of the patient being treated;

a U-shaped chin strap pivotally mounted adjacent the top of the carriage, the pivotal motion permitting the lower end of the chin strap to swivel toward and away from said back-of-the-neck pad;

chin pad means on the lower end of the chin strap contoured to engage around the chin of the person being treated;

said pivoting motion providing for the back of the neck of a patient to be engaged with said back-of-the-neck pad and the chin of the person to be engaged with said chin strap pad means with the chin strap being oriented at an angle to the vertical motion of the carriage whereby upward motion of the carriage causes the pads to respectively grip the chin and back of the neck and pull the person's head in an upward direction;

and said pivoting motion of said chin strap providing for quick release of the person's head by the person moving his head straight upward and flipping the chin strap away.

* * * * *